United States Patent [19]

Botos et al.

[11] 4,060,076

[45] Nov. 29, 1977

[54] BREATHING APPARATUS INCORPORATING DEPTH COMPENSATION

[75] Inventors: Imre Botos, Lidingo; Ivan Aldine Hellquist, Rotebro, both of Sweden

[73] Assignee: AGA Aktiebolag, Lidingo, Sweden

[21] Appl. No.: 661,491

[22] Filed: Feb. 26, 1976

[30] Foreign Application Priority Data

Mar. 14, 1975 Sweden ..... 7502856

[51] Int. Cl.[2] ..... A62B 7/00

[52] U.S. Cl. ..... 128/142 R; 137/81; 114/16 E; 61/69 R

[58] Field of Search ..... 128/142 R, 142.2, 142.3, 128/146.5, 147, 202, 203, 204, 191 R, 195 R, 142.4; 137/81, 494; 114/16 E, 16 A; 61/70 R, 69 R

[56] References Cited

U.S. PATENT DOCUMENTS

| | | | |
|---|---|---|---|
| 3,195,538 | 7/1965 | Galeazzi | 128/142.2 |
| 3,487,647 | 1/1970 | Brecht, Jr. | 114/16 E |
| 3,820,348 | 6/1974 | Fast | 61/70 R |
| 3,827,432 | 8/1974 | Lundgren et al. | 128/142.2 |

*Primary Examiner*—Robert W. Michell

*Assistant Examiner*—Henry J. Recla

*Attorney, Agent, or Firm*—Larson, Taylor and Hinds

[57] ABSTRACT

Breathing apparatus is provided for use under water which comprises a connection device such as a helmet, mask, or the like and a breathing circuit in communication with the connection device. The breathing circuit includes a carbon-dioxide absorber and an expansible gas chamber, and, in operation, provides a first operating period wherein the breathing circuit is closed and a breathing gas is caused to circulate in the breathing circuit until the oxygen concentration of the circulating breathing gas is reduced to a predetermined value and a second operating period, which alternates with the first, wherein the used breathing gas is released to ambient and a fresh gas, the quantity of which is substantially independent of the depth of the user under the water surface, is applied to the breathing circuit. To compensate for a change in floating capacity resulting from a decrease in the volume of the expansible gas chamber caused by an increase in the diving depth, a valve is disposed in a connection between a fresh-gas container and the breathing circuit, the valve being controlled responsive to the pressure of the ambient environment to cause release of further fresh gas from the fresh gas container when the diving depth is increased.

4 Claims, 2 Drawing Figures

BREATHING APPARATUS INCORPORATING DEPTH COMPENSATION

FIELD OF THE INVENTION

Figure 1:
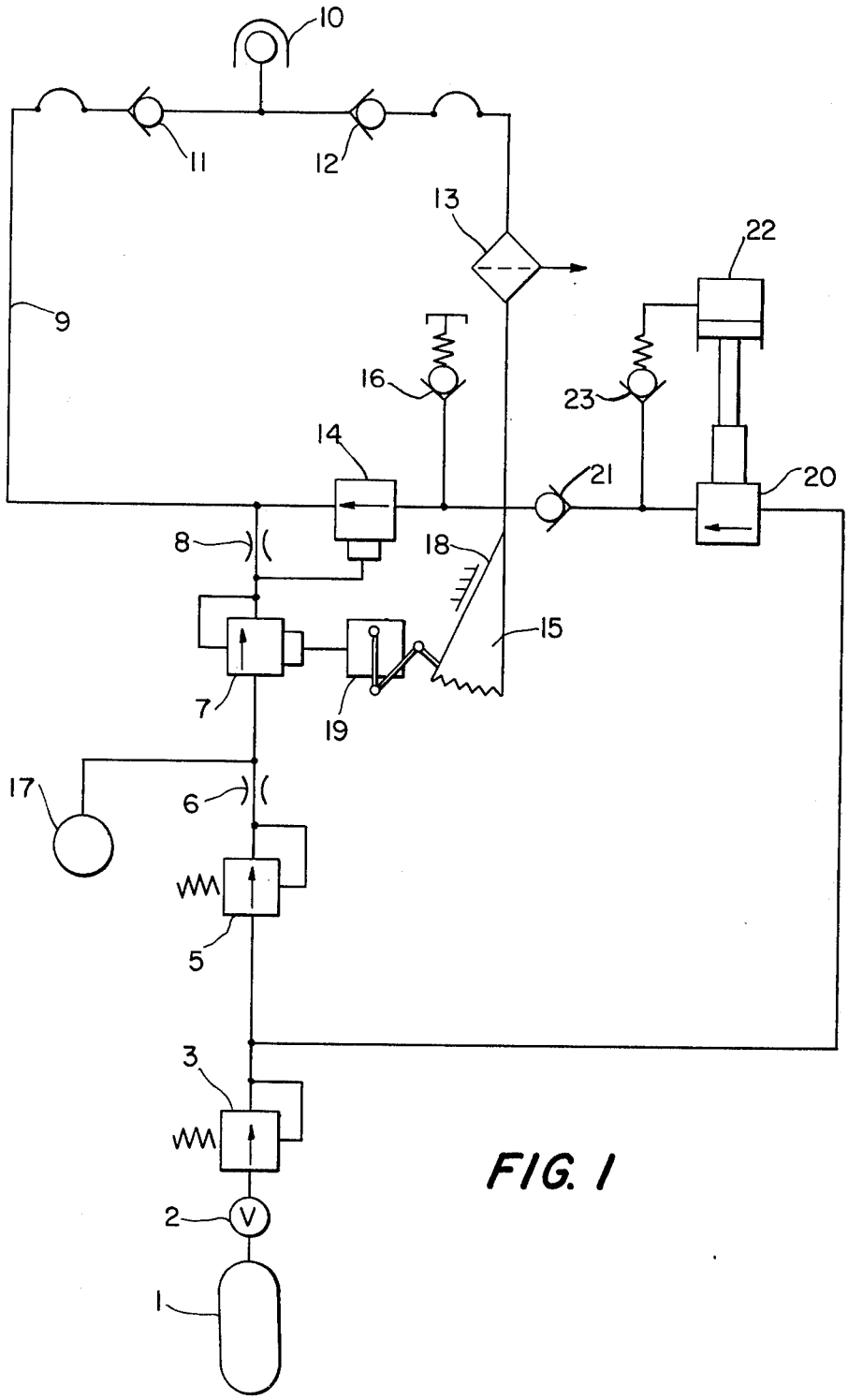

The present invention relates to a breathing apparatus for use under water and, in particular, to an improvement in such an apparatus which provides depth compensation.

BACKGROUND OF THE INVENTION

The present invention is an improvement in a breathing apparatus of the type which includes a connection device for connection to the breathing organs of a user such as a helmet, a breathing mask or mouth piece, and a breathing circuit connected to the connection device. The breathing circuit comprises a carbon-dioxide absorber and an expansible gas chamber such as a breathing bag or bellows. The breathing apparatus also includes suitable controls which control the operation of the breathing circuit to provide (i) a first operating period wherein the breathing circuit is closed and a breathing gas is caused to circulate in the breathing circuit until the oxygen concentration of the circulating breathing gas is reduced to a predetermined value and (ii) a second operating period, which alternates with the first, wherein used breathing gas is released to the ambient environment and a fresh gas, the quantity of which is substantially independent of the depth of the use under the water surface, is supplied to the breathing circuit. A breathing apparatus of this kind is disclosed in U.S. Pat. No. 3,827,432 (Lundgren et al) and the disclosure of that patent is hereby incorporated by reference. Apparatus of this type possesses the advantages that very little of the gas is consumed irrespective of the diving depth and that the proportion of the oxygen used may be maintained within narrow limits. However, when the diving depth is increased, such apparatus suffer shortcomings. More specifically, when the expansible gas chamber is compressed due to the increased diving depth, a certain reduction of the floating capacity of the unit results. This loss of floating capacity is a disadvantage in many applications and an inconvenience in all applications.

SUMMARY OF THE INVENTION

In accordance with the present invention, an improved breathing apparatus is provided which overcomes the disadvantages of the prior art discussed above. In particular, the breathing apparatus of the present invention compensates for a change in floating capacity resulting from a decrease in the volume of the expansible gas chamber caused by an increase in the ambient pressure. The invention concerns the provision of a valve disposed in a connection between a fresh gas container and a breathing circuit which is controlled responsive to the pressure of the ambient environment and is caused to release further fresh gas from the fresh gas container when the diving depth is increased. This provides the necessary compensation for the change in floating capacity resulting from a decrease in the volume of the expansible gas chamber.

The valve is preferably controlled by a pressure sensor in the form of a diaphragm chamber including a diaphragm which is movable responsive to the ambient pressure and is connected to the operating member of the valve. The interior of the valve chamber communicates with a conduit from the fresh gas container to the breathing circuit by means of an overpressure valve which opens into the diaphragm chamber.

In accordance with a further embodiment, the ambient pressure may be sensed by a movable wall in the expansible gas chamber. In this embodiment, the breathing circuit is connected, through a conduit containing a valve controlled by the position of the movable wall, to an operator for the first mentioned valve.

Other features and advantages of the invention will be set forth in, or apparent from, the detailed description of the preferred embodiments found hereinbelow.

BRIEF DESCRIPTIONS OF THE DRAWINGS

Figure 2:
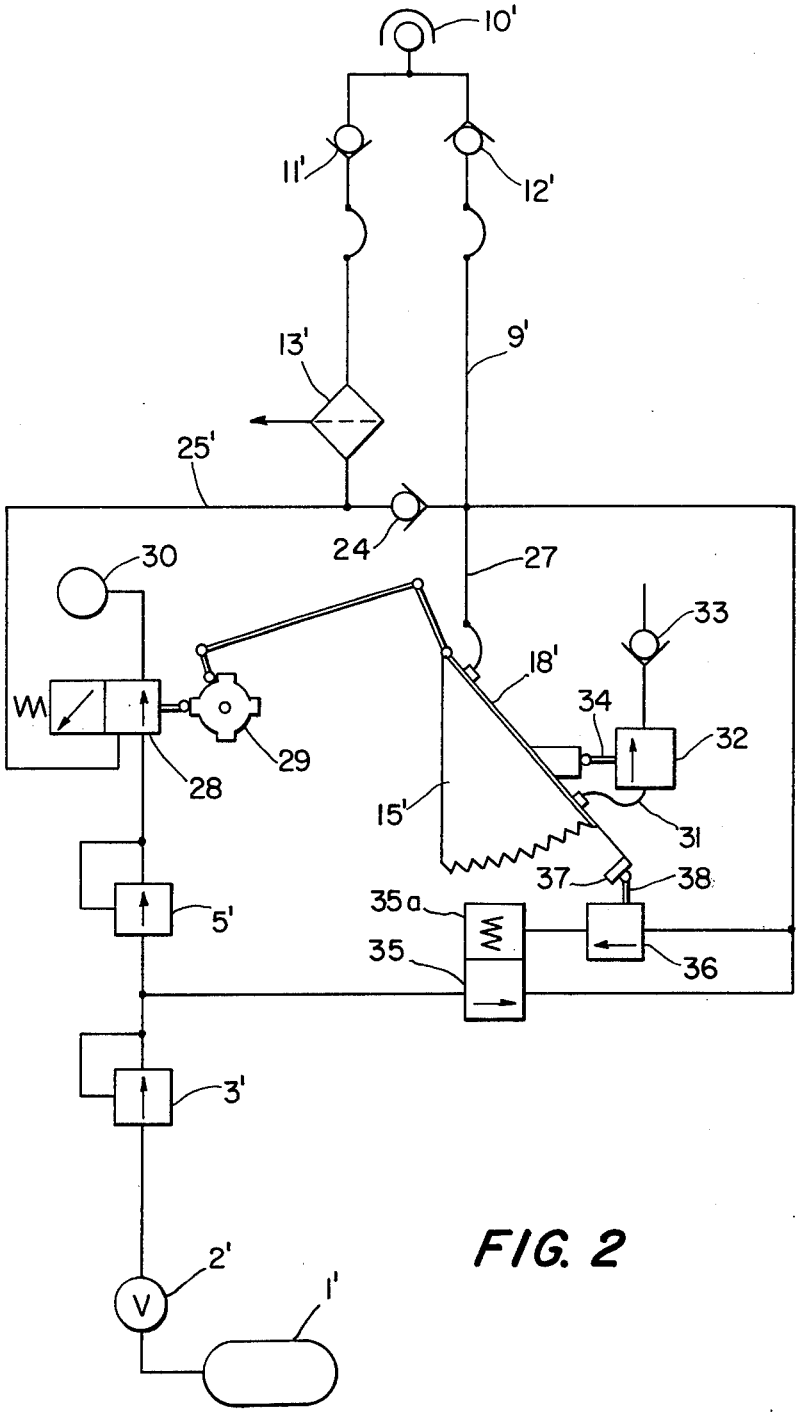

FIG. 1 is a schematic diagram of a first embodiment of the under water breathing apparatus of the invention; and FIG. 2 is a schematic diagram of a second embodiment of the invention.

DESCRIPTION OF THE PRFERRED EMBODIMENTS

Referring to FIG. 1, a breathing apparatus is shown wherein breathing gas is supplied from a fresh-gas container 1, through a valve 2, to a primary pressure regulator 3, a secondary pressure regulator 5, a throttle 6, a controllable valve 7, and a second throttle 8, to a breathing circuit 9. Breathing circuit 9 is connected to a connector, such as a helmet, breathing mask or mouth piece, adapted to communicate with the breathing organs of a user. In the embodiment of FIG. 1, the connector 10 is indicated schematically as being a helmet.

The breathing circuit 9 includes non-return valves 11 and 12, an absorber 13 for absorbing carbon-dioxide, and a controllable valve 14. A bellows 15 is also connected to breathing circuit 9, as is a loaded or biased outlet valve 16.

A dosing bottle 17 is connected to a point between the throttle 6 and the controllable valve 7. Valve 7 is arranged to be controlled relative to movements of a movable wall 18 of bellows 15 by means of an actuator or operating unit 19. Reference is made to U.S. Pat. No. 3,827,432 for a further description of the aspect of the breathing circuit.

The controls provided in the breathing apparatus of FIG. 1 provide two operating periods. During the first operating period, the breathing circuit 9 is closed and the breathing gas is caused to circulate in the breathing circuit while carbon-dioxide is absorbed, by absorber 13, until the oxygen concentration in the circulating breathing gas has decreased to a predetermined value. During the second operating period, which alaternates with the first operating period, consumed or used breathing gas is blown out or released into the ambient environment through the loaded outlet valve 16 and fresh gas is applied from the dosing bottle 17, through valve 7 and throttle 8, to the breathing circuit 9. During this second operating period, the controllable valve 14 in breathing circuit 9 is closed.

In order to compensate for the decrease in floating capacity which results when the diving depth is increased and the bellows 15 is thus compressed, a controllable valve 20 is connected in a conduit which is connected between the outlet of primary pressure regulator 3 and the breathing circuit 9 in the vicinity of the connection to bellows 15. This conduit also includes a non-return valve 21. Valve 20 is controlled by the diaphragm of a diaphragm chamber 22, one side of the diaphragm being in communication with the ambient environment the other side being in communication with the interior of chamber 22 so that movement of the diaphragm is controlled in accordance with the differential between the ambient pressure and the chamber pressure. Diaphragm chamber 22 is connected through a loaded non-return valve 23 to the conduit connection between valve 20 and non-return valve 21.

Considering the operation of the embodiment of FIG. 1, when the diving depth is increased, the diaphragm chamber 22 moves to compress the gas in the diaphragm chamber and to open the valve 20 controlled by the diaphragm. With valve 20 open, further fresh gas from the fresh gas container 1 is released through the non-return valve 21 to the breathing circuit 9. When a predetermined counter pressure is produced in the breathing circuit, the spring-loaded non-return valve 23 opens so that gas can enter diaphragm chamber 22. This gas increases the pressure in the chamber 22 causing outward movement of the diaphram and consequent closing of valve 20. The gas from fresh gas container 1 produces a expansion of bellows 15 and thus an increase in floating capacity to compensate for the loss due to the increased diving depth.

Referring to FIG. 2, a second embodiment of the invention is shown. The embodiment of FIG. 2 includes a number of components in common with the embodiment of FIG. 1 and these components have been given the same numbers with primes attached. In the embodiment of FIG. 2, a breathing mask 10' is connected to a breathing circuit 9' which includes a pair of non-return valves 11' and 12' as well as an absorber 13'. A non-return valve 24 is connected between a conduit 25 for supplying fresh gas and a conduit 27 which is connected to the movable wall 18' of a bellows 15'. Similarly to the embodiment of FIG. 1, the fresh gas is supplied from a container 1' through a valve 2', a primary pressure regulator 3' and a secondary pressure regulator 5'. A valve unit 28 is connected to secondary pressure regulator 5' and is adjustable to one of two positions by means of a cam wheel 29. In a first position, the output conduit from secondary pressure regulator 5' is directly connected to a dosing bottle 30 so that the later will be filled with a predetermined refilling quantity. In the second position, dosing bottle 30 is connected to breathing circuit 9' through conduit 25. Control cam or cam wheel 29 is driven responsive to movements of the movable wall 18' of bellows 15' in a manner which is described in more detail in U.S. Pat. No. 3,827,432, referred to above.

In order to provide blowing out or release of the consumed breathing gas to the ambient, bellows 15' is provided with a connection 31 to a controllable valve 32 and an exhaust valve 33 which acts as a non-return valve. As indicated by connecting rod 34, valve 32 is also controlled by movements of a movable wall 18' of bellows 15'. Similarly to the embodiment of FIG. 1, the breathing apparatus of the embodiment of FIG. 2 provides two operating periods. During the first operating period, the breathing circuit 9' is closed and the breathing gas is caused to circulate therein. At the same time, the dosing bottle 30 is refilled through valve unit 28. During the second operating period, the used breathing gas is blown out to the surroundings through valves 32 and 33 and fresh gas is supplied from the dosing bottle through the valve unit 28 and conduit 25 to the breathing circuit 9'.

In accordance with the present invention, to compensate for a decrease in floating capacity produced when the diving depth is increased and the bellows 15' is compressed, additional gas is arranged to be supplied to the breathing circuit through a controllable valve 35. Valve 35 is inserted in the connection between the output of primary pressure regulator 3' and the point in breathing circuit 9' to which the bellows 15' is connected. Valve 35 comprises a valve seat which is sealed by a spring loaded membrane. The spring housing which is denoted **35*a* is connected to an actuator valve 36 to the breathing circuit 9'. Actuator valve 36 is itself actuated responsive to movements of movable wall 18' of bellows 15' through means of a guide rail 37 which is connected to movable wall 18' and is arranged to engage a rod 38 which directly control valve 36. When the diving depth is increased, bellows 15' is compressed and valve 36 is adapted to be closed when bellows 15' is compressed about 10%. Under these circumstances, the spring housing 35*a* forms an enclosure having a movable wall formed by the flexible valve diaphragm. When the ambient pressure is increased, the gas enclosed within the housing 35*a* is compressed and the diaphragm lifts from the valve seat of valve 35. Under these circumstances, fresh gas is permitted to pass through the valve 35 to the breathing circuit 9'. When the decrease in volume of the bellows 15' is compensated for, so that valve 36 again opens, the difference in pressure between that of spring housing 35*a* and breathing 9' is equalized so that the spring force returns the diaphragm of valve 35** to the closed position. In this manner, the decrease in floating capacity is compensated for and the normal floating capacity restored.

Although the invention has been described relative to examplary embodiments thereof, it will be understood by those skilled in the art that variations and modifications can be effected in these embodiments without departing from the scope and spirit of the invention.

We claim:

1. Breathing apparatus for use under water comprising: a fresh gas container, connection means for connecting the apparatus to the breathing organ of a user, a breathing circuit in communication with said connection means and comprising carbon-dioxide absorbing means in communication with said connecting means, an expansible gas chamber in communication with said connection means and control means for controlling the operation of said breathing circuit to provide (i) a first operating period wherein said breathing circuit is closed and a breathing gas is caused to circulate in said breathing circuit until the oxygen concentration of the circulating breathing gas is reduced to a predetermined value and (ii) a second operating period, which alternates with said first period, wherein the used breathing gas is released to the ambient environment and a fresh gas, the quantity of which is substantially independent of the depth of the user under the water surface, is supplied to the breathing circuit; wherein the improvement comprises a valve means disposed in a connection between said fresh-gas container and said breathing circuit, and means for sensing the pressure of the ambient environment and for controlling said valve means to cause release of further fresh gas from said fresh gas container through said valve means to the breathing circuit when the diving depth of the user is increased whereby a change in floating capacity resulting from a decrease in the volume of the expansible gas chamber of the breathing circuit is compensated for.

2. Apparatus according to claim 1 wherein said sensing means comprises a diaphragm chamber including a diaphragm movable responsive to the pressure of the ambient environment, said valve means including a valve operator and said diaphragm being connected to said valve operator.

3. Apparatus according to claim 2 wherein the interior of said diaphragm chamber is in communication with a conduit which connects said fresh gas container to said breathing circuit, said conduit including an overpressure valve which opens into said diaphgram chamber.

4. Apparatus according to claim 1 wherein said sensing means comprises a movable wall of said expansible gas chamber, said apparatus further comprising operating means for said valve means and a conduit, including a valve controlled by the position of the movable wall of said expansible gas chamber, for connecting said breathing circuit to said valve operating means.

* * * * *